US005195251A

United States Patent [19]

Gyurcsek et al.

[11] Patent Number: 5,195,251

[45] Date of Patent: Mar. 23, 1993

[54] DRYING KILN

[76] Inventors: Frank T. Gyurcsek, 830 Graham Road, Kelowna, B.C., Canada, V1X 1J4; Martin G. Gyurcsek, 29 - 1410 High Rd., Kelowna, B.C., Canada, V1Y 7B3

[21] Appl. No.: 839,537

[22] Filed: Feb. 19, 1992

[51] Int. Cl.[5] ..... F26B 3/00

[52] U.S. Cl. ..... 34/22; 34/191; 34/29; 34/34; 34/54

[58] Field of Search ..... 34/218, 219, 191, 13.8, 34/22, 16.5, 24, 26, 29, 34, 54, 225

[56] References Cited

U.S. PATENT DOCUMENTS

| | | | |
|---|---|---|---|
| 1,413,018 | 4/1922 | Fujino . | |
| 2,064,965 | 12/1936 | Will | 21/10 |
| 3,149,932 | 9/1964 | Bachrich | 34/191 |
| 3,477,139 | 11/1969 | Hildebrand | 34/191 |
| 3,646,687 | 3/1972 | Berzin et al. | 34/13.8 |
| 3,867,765 | 2/1975 | Foster | 34/13.8 |
| 4,014,107 | 3/1977 | Bachrich | 34/191 |
| 4,098,008 | 7/1978 | Schuette et al. | 34/191 |
| 4,176,464 | 12/1979 | Randolph | 34/16.5 |
| 4,182,048 | 1/1980 | Wolfe et al. | 34/13.8 |
| 4,250,629 | 2/1981 | Lewis | 34/13.8 |
| 4,344,237 | 8/1982 | Willington | 34/191 |
| 4,485,564 | 12/1984 | Iverlund et al. | 34/1 |
| 4,662,083 | 5/1987 | Carter et al. | 34/191 |
| 4,862,599 | 9/1989 | Brunner | 34/46 |
| 4,955,146 | 9/1990 | Bollinger | 34/191 |

*Primary Examiner*—Henry A. Bennet
*Assistant Examiner*—Denise L. F. Gromada
*Attorney, Agent, or Firm*—Townsend and Townsend

[57] ABSTRACT

A kiln and method for drying material. The kiln includes a drying chamber, a heating system for heating air to be delivered to the drying chamber, and a ducting system for delivering heated air to the drying chamber. Fans are provided for establishing a low air pressure region and a high air pressure region adjacent the ducting system in order to generate a circulation flow of air throughout the drying chamber. The ducting system is arranged to deliver heated air only into the low air pressure region of the fan to ensure proper mixing of the heated air from the ducting and recirculated air. In a second embodiment, the fans are reversible to permit air flow through the drying chamber to be reversed.

9 Claims, 2 Drawing Sheets

DRYING KILN

FIELD OF THE INVENTION

This invention relates to a kiln for drying materials.

BACKGROUND OF THE INVENTION

Drying kilns are used in the lumber industry for drying cut lumber to a desired moisture content. Generally, these kilns comprise a large drying chamber into which stacked lumber to be dried is placed. The stacked lumber is often supported on rail cars that are movable on a track system in the drying chamber to permit easy and efficient movement of lumber through the kiln.

The drying kiln is generally operated in a batch process, that is, a batch of lumber is moved into the drying chamber, the chamber is sealed and then heated air is blown over and through the stacked lumber in order to remove excess moisture to a pre-determined level. The heated air is mixed with both fresh air from outside the kiln and recirculated air. At the end of the drying period, the heated air is turned off, the drying chamber unsealed and the dried lumber is then removed. The process is then started with another batch of lumber.

There are problems with existing drying kilns dealing chiefly with the circulation of heated air through the drying chamber. There is a tendency for the heated air being directed across the lumber to be unevenly distributed leading to over drying and resultant distortion and even charring of the lumber in some locations and under drying of the lumber in other locations. This problem is also due to inadequate mixing of the heated air with recirculated air which can result in a definite temperature variance across the airstream being blown through the stacked lumber which leads to uneven drying.

Examples of prior art drying kilns for various materials are disclosed in the following patents:

U.S. Pat. No. 1,413,018 to Fujino
U.S. Pat. No. 2,064,965 to Will
U.S. Pat. No. 3,477,139 to Hilderbrand
U.S. Pat. No. 3,646,687 to Berzin
U.S. Pat. No. 3,867,765 to Foster
U.S. Pat. No. 4,014,107 to Bachrich
U.S. Pat. No. 4,098,008 to Schuette
U.S. Pat. No. 4,176,464 to Randolph
U.S. Pat. No. 4,182,048 to Wolfe
U.S. Pat. No. 4,250,629 to Lewis
U.S. Pat. No. 4,485,564 to Iverlund
U.S. Pat. No. 4,862,599 to Brunner and
U.S. Pat. No. 4,955,146 to Bollinger Some of the foregoing patented designs have been developed specifically to address or avoid the problems of heated air distribution and circulation.

For example, Iverlund discloses a drying kiln that uses microwaves to dry wood instead of heated air and Berzin avoids the problems associated with using heated air by disclosing a wood drying apparatus that subjects wood to ammonia at elevated temperatures and pressures.

Lewis discloses a lumber drying kiln that employs a dehumidifier to treat the heated air being blown over and through the stack of lumber.

Randolph discloses a drying kiln and a method for controlling the operation of the kiln. Randolph relies on a relatively complex arrangement of monitoring the weight of the lumber and the moisture content of the drying air to adjust the drying action so as to control the moisture removal rate.

Foster discloses a drying kiln that employs upper air circulating fans and a central heated air duct.

Bollinger discloses a lumber drying kiln that includes an air treatment and circulating assembly adjacent the top wall that includes a series of reversible fans for distributing air past a series of heating coils.

Schuette discloses a drying kiln that incorporates a fan assembly for directing air to opposite sides of the drying chamber using fans arranged along a longitudinal axis of the chamber. The fans rotate to direct air along a duct and a series of pivoting valves control the direction of air flow.

Wolfe and Bachrich disclose drying kilns that use fans that can be driven in both directions to circulate air to the drying chamber.

Brunner shows a drying kiln that has an arrangement of axial fans mounted for swivelable rotation about a vertical axis.

Hilderbrand discloses a further example of a drying kiln having a swivelable fan to circulate air in opposite directions.

None of the foregoing kiln designs have achieved wide spread acceptance.

SUMMARY OF THE INVENTION

The present invention provides a kiln and method for drying material that permits fast drying of the material at increased efficiencies.

The present invention provides a kiln for drying material comprising:

a drying chamber;

means for heating air to be delivered to the drying chamber;

passage means for delivering heated air to the drying chamber;

means for establishing a low air pressure region and a high air pressure region adjacent the passage means in order to generate a circulation flow of heated air throughout the drying chamber; and vent means associated with the passage means for permitting heated air to exit only in the established low air pressure region.

Preferably, the means for establishing low and high air pressure regions comprises at least one fan mounted adjacent a heated air ducting system for delivering heated air to the drying chamber. The fan is mounted to allow for rotation of the fan to permit the circulation of air to be reversed within the drying chamber. A ducting system and valve system are provided to ensure that even when the fans are reversed, heated air is delivered only to the low pressure side of the fan.

The present invention also provides a method for drying material in the drying chamber of a kiln comprising:

delivering heated air to the drying chamber through an enclosed passage;

establishing a low air pressure region and a high air pressure region adjacent the enclosed passage in order to generate a circulation flow of air throughout the drying chamber; and permitting heated air to exit from the enclosed passage only in the established low air pressure region.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
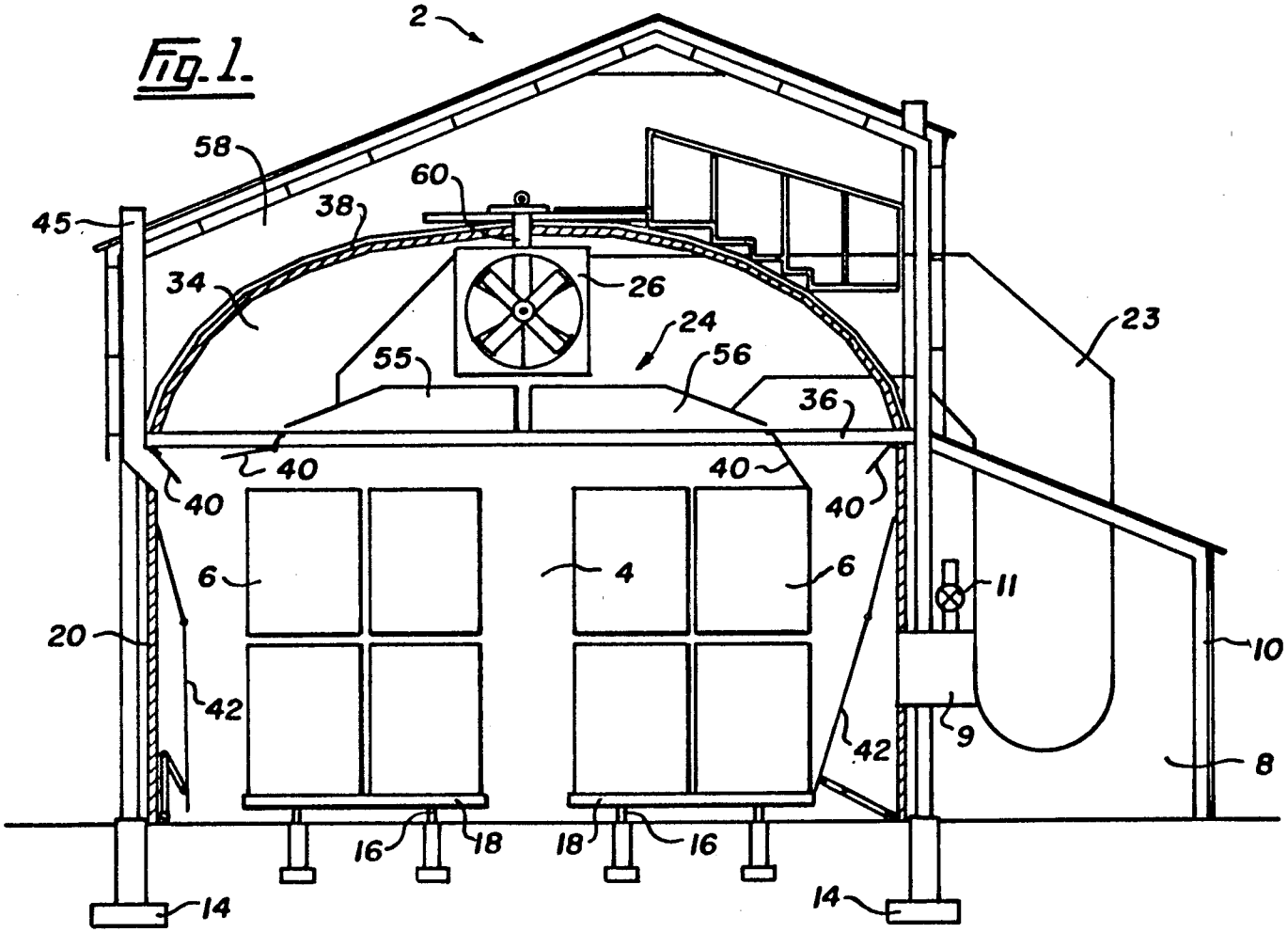
FIG. 1 is an end section view through a first embodiment of the kiln.

FIG. 1 shows a drying kiln 2 according to the present invention in a cross-sectioned end view. Kiln 2 comprises a structure that includes a drying chamber 4 for receiving stacks of lumber 6 to be dried and means for heating air to be delivered to the drying chamber in the form of a conventional gas burner unit 8 housed in enclosure 10. The kiln is a constructed conventionally with concrete footers 14 supporting the building framework. A rail system 16 is provided within drying chamber 4 to permit rail cars 18 loaded with stacked lumber 6 to be quickly and efficiently moved into the drying chamber through large end doors (not shown). Drying chamber 4 is insulated using conventional insulation material 20.

Gas burner unit 8 communicates with drying chamber 4 through passage means in the form of large duct 23 which merges into duct system 24 extending the length of the drying chamber above the chamber. Duct system 24 delivers heated air produced by burner unit 8 to the drying chamber.

Once delivered to drying chamber 4 heated air is circulated through the drying chamber by means for establishing a low air pressure region and a high air pressure region adjacent the duct system comprising a series of fans 26 mounted above duct system 24.

Fans 26 are present to generate air flow through the drying chamber. Fans 26 and hot air duct system 24 are situated in an enclosed region 34 above the drying chamber that communicates with the drying chamber through slots 36 that extend the length of the drying chamber. Enclosed region 34 is formed with an insulated domed upper surface 38 to assist in smoothly directing air flow into the drying chamber.

As is conventional, a series of pivotable flaps 40 and hinged plates 42 are provided to position against the stacks of lumber to prevent air flow from travelling beneath the rail cars and short circuiting across the very top of the lumber stacks. A return air duct 9 is provided between the interior of the drying chamber and the gas burner unit to permit partial recirculation of the heated air through duct system 24. A portion of the heated air is also recirculated through the interior of the drying chamber. Return air duct 9 is also provided with a fresh air intake 11 that has a variable aperture to control the amount of fresh air introduced and mixed into the heated air stream exiting from the drying chamber. Otherwise, fresh air is introduced into the air stream by air drawn through burner unit 8 and not involved in the combustion of the gas. Stack 45 is provided in the roof of the kiln to permit escape of air from the drying chamber interior if the chamber internal pressure becomes too great.

A number of possible arrangements of the fans and the duct system are possible within upper enclosed region 34.

Figure 2:
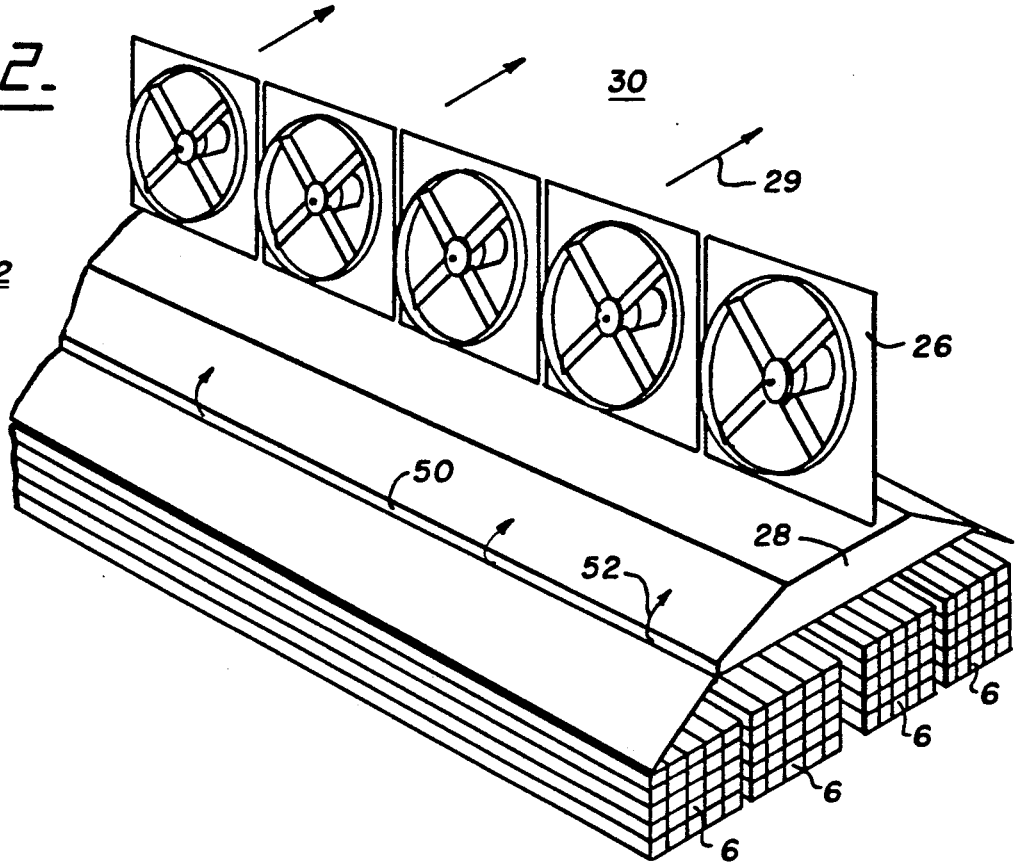
FIG. 2 is a detail view showing an arrangement of the fan and duct system of the present invention for circulating heated air.

Referring to FIG. 2, there is shown a first such arrangement. In the embodiment of FIG. 2, there is a single duct 28 extending over the drying chamber and fans 26 are mounted for rotation in a single direction to drive air in the direction indicated by arrows 29. Rotation of the fans establishes a high air pressure region at 30 and a low pressure region at 32 to establish air flow through the drying chamber.

Duct 28 is formed with vent means in the form of a single slot 50 extending the length of duct 28. Slot 50 is formed only along one edge of duct 28, the edge that is adjacent low air pressure zone 32. This ensures that heated air from duct 28 is drawn into the low pressure zone as indicated by arrows 52 and rapidly mixed with air that has already been circulated through the drying chamber. Heated air being drawn from duct 28 into the already established air flow leads to turbulence in the low air pressure zone which tends to mix the heated and recirculated air to promote a uniformly heated flow of air in the drying chamber which in turn promotes more even drying of the stacked lumber. Furthermore, the air that begins mixing in low air pressure region 32 is mixed to an even greater extent as it passes through fans 26.

Figure 3:
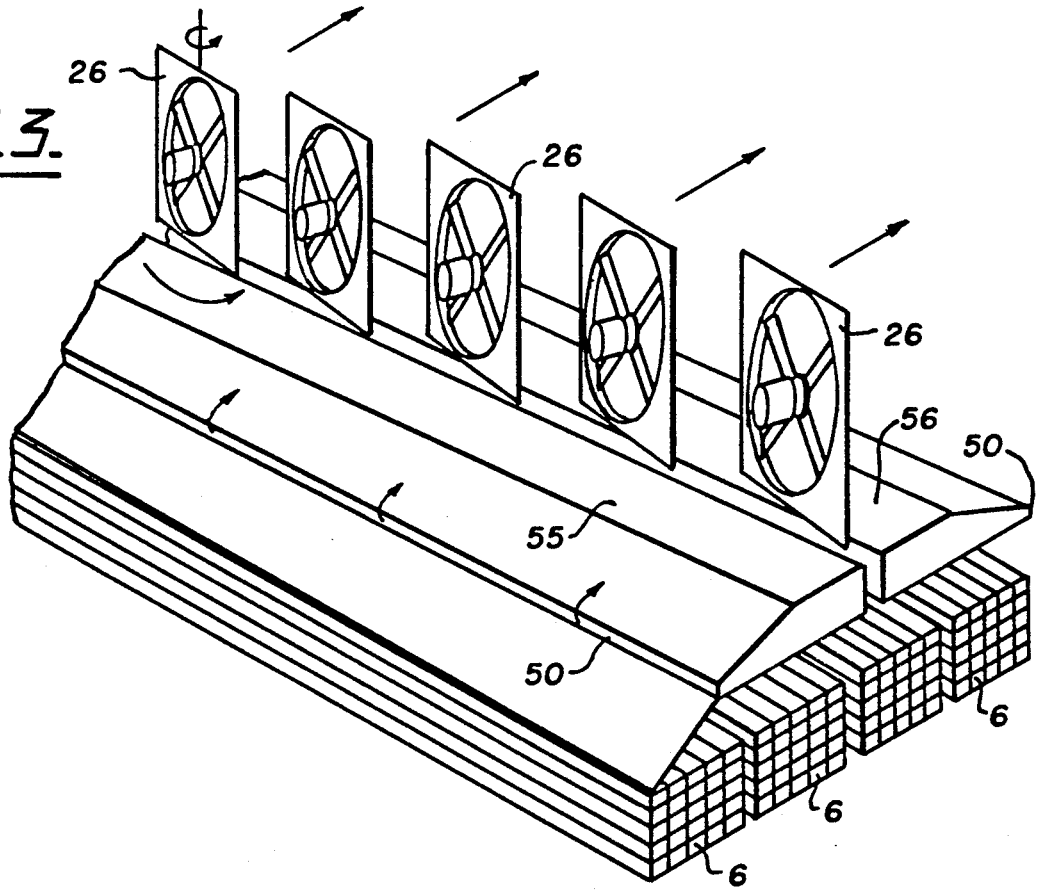
FIG. 3 is a detail view showing a further fan and duct system arrangement including swivelable fans for reversing air flow through the drying chamber.

Referring to FIG. 3, there is shown an alternative fan and duct arrangement. In this case, fans 26 are mounted for swivelable movement about a vertical axis parallel to the plane of rotation of the fan blades. The fans are rotated about their axis at periodic intervals to reverse the circulation of the air flow in the drying chamber. Periodic reversal of air flow direction tends to result in more uniform drying of the stacked lumber. Reversal of the air flow direction makes it necessary that duct system 24 comprise a pair of separate ducts 55 and 56 extending substantially the length of the drying chamber and each formed with a slot vent 50 that opens toward opposite sides of the drying chamber so that heated air can always be directed to the low pressure side of the fans. Since the fan blades always rotate in the same direction, they are preferably airfoil shaped for most efficient delivery of air.

Valve means are provided in ducts 55 and 56 to permit switching of the heated air flow to the duct adjacent low pressure region 32. For example, the valve means can comprise a baffle plate co-ordinated to move in response to rotation of the fans to block the duct on the high pressure side of the fan.

FIG. 1 illustrates a fan and duct arrangement in the manner of FIG. 3. There is an access attic 58 constructed over enclosed region 34 to permit mounting of each fan 26 to a vertical swivelable axis 60 that extends into the attic. In FIG. 1, fan 26 is shown in the process of switching from one side of the drying chamber to the other. This illustrated position of the fan represents a transient state and the fan would not normally be left in this position.

As a final fan and duct arrangement, the arrangement of FIG. 3 can be modified by substituting fans having a reversible direction instead of fans mounted for swivelable movement about a vertical axis. At intervals, the fan blade rotation is reversed to direct air flow through the drying chamber in both directions. The valve means is co-ordinated with the direction of rotation of the fans to block heated air to the duct on the high pressure side of the fan.

Although the present invention has been described in some detail by way of example for purposes of clarity and understanding, it will be apparent that certain changes and modifications may be practised within the scope of the appended claims.

I claim:

1. A kiln for drying material, comprising:

a drying chamber;

means for heating air to be delivered to the drying chamber;

passage means for delivering heated air to the drying chamber, comprising a pair of ducts extending substantially the length of the drying chamber;

means for establishing a low air pressure region and a high air pressure region adjacent the pair of ducts in order to generate a circulation flow of heated air throughout the drying chamber;

venting means in the pair of ducts to permit heated air to exit from the ducts; and valve means for controlling heated air flow in the pair of ducts such that heated air is always directed to the duct adjacent the low air pressure region;

said means for establishing a low air pressure region and a high air pressure region permitting periodic switching of said regions to reverse circulation of the air flow within the drying chamber with coordinated switching of the valve means such that heated air is always directed to the low air pressure region.

2. A kiln as claimed in claim 1 in which the means for establishing a low air pressure region and a high air pressure region comprise at least one fan.

3. A kiln as claimed in claim 1 in which the means for establishing a low and high air pressure region comprises at least one fan mounted for swivelable movement about an axis parallel to the plane or rotation of the fan.

4. A kiln as claimed in claim 1 in which the means for establishing a low and high air pressure region comprises at least one fan having a reversible direction of rotation.

5. A kiln as claimed in claim 1 in which the venting means comprises a slot extending the length of each duct and opening toward opposite sides of the drying chamber.

6. A kiln as claimed in claim 1 in which the valve means comprises a baffle plate movable to direct heated air into the duct of said pair of ducts that is adjacent the low air pressure region.

7. A kiln as claimed in claim 1 in which the passage means and the means for establishing a low air pressure region and a high air pressure region are located in an enclosed region above the drying chamber that is in communication with the drying chamber.

8. A kiln as claimed in claim 7 in which the enclosed region is formed with a domed upper surface to assist in directing air flow.

9. A method for drying material in the drying chamber of a kiln, comprising:

delivering heated air to the drying chamber through a pair of ducts extending substantially the length of the drying chamber;

establishing a low air pressure region adjacent to one of the ducts and a high air pressure region adjacent to other of the ducts in order to generate a circulation flow of heated air throughout the drying chamber;

controlling the heated air flow with valve means such that substantially all the flow is delivered to the duct adjacent to the low air pressure region and heated air exits from said duct into the low air pressure region; and periodically switching said regions to reverse circulation of the air flow with coordinated switching of the valve means such that heated air is always directed to the duct adjacent to the low air pressure region.

* * * * *